United States Patent [19]

Ward

[11] 4,289,097

[45] Sep. 15, 1981

[54] SIX-CYCLE ENGINE

[76] Inventor: Charles P. Ward, 5609 Selford Rd., Arbutus, Md. 21227

[21] Appl. No.: 94,040

[22] Filed: Nov. 13, 1979

[51] Int. Cl.[3] ..... F02B 19/02; F02B 75/02

[52] U.S. Cl. ..... 123/292; 123/64; 123/284

[58] Field of Search ..... 123/292, 64, 262, 263, 123/259, 281, 284, 283, 285, 286

[56] References Cited

U.S. PATENT DOCUMENTS

| | | | |
|---|---|---|---|
| 1,068,173 | 7/1913 | Schimanek | 123/64 |
| 3,662,543 | 5/1972 | Milisavljevic | 123/64 |
| 3,809,030 | 5/1974 | Moiroux | 123/292 |

FOREIGN PATENT DOCUMENTS

| | | | |
|---|---|---|---|
| 55037 | 3/1934 | Norway | 123/292 |

*Primary Examiner*—Craig R. Feinberg
*Attorney, Agent, or Firm*—Walter G. Finch

[57] ABSTRACT

The invention is an improved six-cycle engine that improves performance in fuel economy and in the power to size ratio. The six cycles are a first intake stroke, a compression and storing stroke, second intake stroke, a compression and combining stroke, the power stroke, and the exhaust stroke. The invention provides for using some of the fuel's energy that ordinarily is lost in the engine's cooling system, by absorbing heat after the first stroke and subsequently using it in the power stroke. A special configuration of a separate chamber for the compression of gases induced in the first intake stroke and a special configuration for the valve to that chamber are part of the design. Two induction cycles are included in the six cycles for each power stroke.

7 Claims, 7 Drawing Figures

SIX-CYCLE ENGINE

BACKGROUND AND SUMMARY OF THE INVENTION

The invention relates to internal combustion engines and in particular to six-cycle engines. Specifically, it relates to the mode of cycling the gases during the operation of the engine.

There are numerous designs of reciprocating internal combustion engines, many are of the four-cycle type. In the six-cycle type various concepts have been used to improve the efficiency. The present invention further improves the art as will be hereinafter described.

The six cycles of the present invention are described hereinafter. It is to be noted that although the chronological order of the cycles may parallel those of other six-cycle engines, the mode of the flow of gases during those six cycles is improved to provide a better efficiency.

The first cycle is an intake stroke, a primary intake of air into the cylinder as the piston moves downward.

The second cycle is a combination compression and storage stroke. As the piston moves upward, the air drawn in during the first cycle is compressed. Most of the air is compressed into a specially configured hot chamber from which the burned gas has just previously been exhausted. A specially configured closing valve stores the air in the hot chamber.

The third cycle is another intake stroke, a secondary intake of air into the cylinder as the piston moves downward.

The fourth cycle is a compression and combining stroke. As the piston moves upward, the air is compressed in the cylinder. As the piston approaches the top of the stroke and as the pressure in the cylinder approaches the pressure in the aforementioned hot chamber (the second cycle) the specially configured valve opens to let the air in the cylinder and in the hot chamber combine by a portion of the air in the cylinder passing into the hot chamber as the piston completes the upward stroke. At this point most of the air that has been taken in is in the hot chamber. At this time fuel is injected into the system through the hot chamber.

The fifth cycle is the power stroke. As ignition occurs the expanding gas drives the piston downward.

The sixth cycle is the exhaust stroke. As the piston moves upward it drives the hot gas from the power stroke out through the exhaust port.

In the above description of the cycles for the background and summary of the invention, no mention was made of the operation of the various valves in the system, except for the one valve in the fourth cycle that permits the gases to combine in the cylinder and hot chamber. The various valves and their cams and operation will be described in detail in the description of the preferred embodiments.

In the previous description of the six cycles, the six cycles started with the primary intake stroke and moved through the exhaust stroke.

The use of the aforementioned hot chamber as a holding chamber and also to capture a portion of the heat from the combustion of the fuel within the chamber provides a means for preheating the air.

As hereinbefore described, the hot chamber becomes part of the combustion chamber during the power stroke.

By use of the six-cycle engine as hereindescribed, improved performance is obtained in fuel economy and in the power to size ratio.

The especially configured hot chamber is elongated and spherical-like to accept the high pressure that the system generates in the power stroke (combustion phase). Likewise the configuration of the hot chamber valve is elongated and spherical-like to provide for an efficient flow around the valve as the heated air and fuel mixture spews from the hot chamber when the valve is open and ignition occurs. The top of the specially configured valve is also configured as a valve means to seal off the clearance around the valve stem at the top side of the specially configured hot chamber and above the specially configured valve.

It is, therefore, an object of the invention to provide six-cycle engine having two intake strokes to each power stroke.

It is another object of the invention to provide a specially configured chamber directly above the cylinder to provide a compression area for the air taken in on the first intake stroke for compression of a six-cycle engine.

It is also an object of the invention to provide a specially configured valve to assist in the flow of gases from a specially configured chamber when the valve is open for the power stroke in a six-cycle engine.

It is still another object of the invention to provide for the injection of fuel through the specially configured chamber in a six-cycle engine.

It is yet another object of the invention to provide a special upper valve-like means to seal off the top of a specially configured chamber when combustion of fuel is occurring within the chamber and cylinder during the power stroke in a six-cycle engine.

Further objects and advantages of the invention will become more apparent in the light of the following description of the preferred embodiments.

DESCRIPTION OF THE PREFERRED EMBODIMENTS

Figure 1:
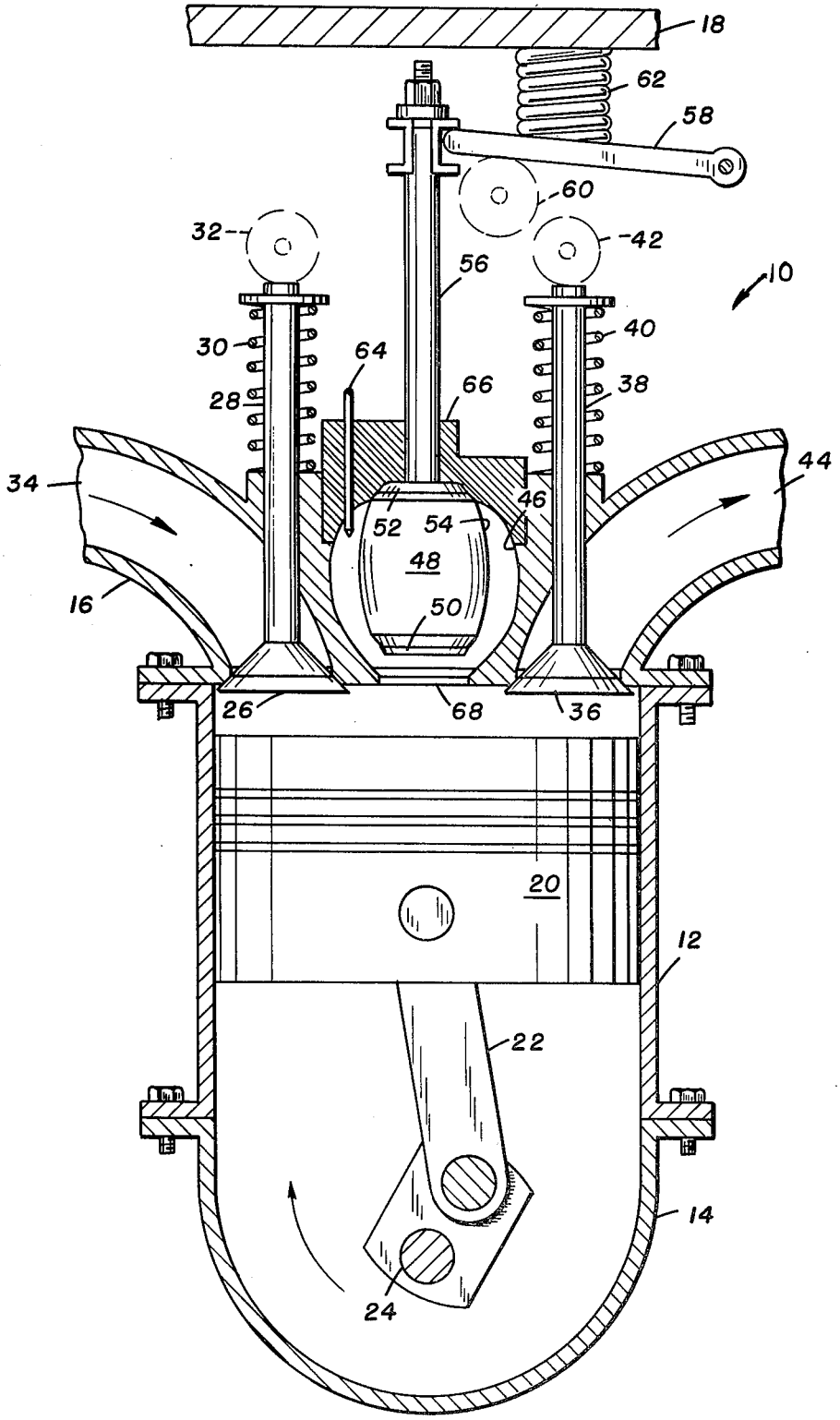
FIG. 1 is a vertical cross section through a piston and cylinder assembly of a six-cycle engine.

Referring to the drawings and particularly to FIG. 1, an improved six-cycle engine is shown at 10.

The six-cycle engine may consist of one or more cylinders and associated mechanisms assembled with it as described in in this invention. A typical cylinder and associated mechanisms of a six-cycle engine is portrayed in FIG. 1 as provided in this invention.

The engine structure consists of cylinder means 12, a crankcase means 14, a valve system means 16, and a head means 18. Only a portion of the cylinder means 12, crankcase means 14, valve system means 16, and head means 18, is shown in order to describe the invention. This partial illustration is sufficient to describe the invention, however, it is to be understood that variation in these elements of structure to obtain the same operation is within the scope and intent of the invention. The cylinder means 12 is constructed in a suitable housing means to which the crankcase means 14 structure is attached, likewise a housing for the valve system means 16 and the head means 18 is also attached to the cylinder means 12 housing to enclose external portions of said valve system means 16.

A typical piston 20, piston rod 22, and crankshaft 24 is illustrated assembled within the cylinder 12 and crankcase 14 areas.

An intake valve 26, intake valve stem 28, intake valve coil spring 30, and intake valve cam 32 operate for the introduction of air into the engine 10. The intake valve 26 is shown closed. When cycled to open, the intake valve 26 admits the introduction of air through the air intake port 34. The arrow indicates the direction of the flow of the air into the air intake port 34.

An exhaust gas valve 36, exhaust gas valve stem 38, exhaust gas valve coil spring 40, and exhaust gas valve cam 42 operate for the elimination of burned gas from the engine 10. The exhaust gas valve 36 is shown closed. When cycled to open, the exhaust gas valve 26 permits the burned gas from the power stroke (described hereinafter) to be eliminated through the exhaust gas exit port 44. The arrow indicates the direction of the flow of the exhaust gas from the exhaust gas exit port.

A special feature of the present invention is the specially configured compression or hot chamber 46 centered within the valve system means 16 and concurrently thereby centered directly over the cylinder means 12 and its enclosed piston 20. The hot chamber 46 encloses the specially configured hot chamber valve 48. The specially configured hot chamber valve 48 has a lower valve portion 50 and an upper valve portion 52, with a spherical-like valve body 54 having the lower valve portion 50 and the upper valve portion 52 thereon. The hot chamber 46, surrounding the hot chamber valve 48, is also spherical-like. A hot chamber valve stem 56, a hot chamber valve lifter assembly 58, a hot chamber valve cam 60, and a hot chamber valve coil spring 62 complete the hot chamber valve mechanism. The hot chamber valve 48 is shown open at the lower valve portion 50 and closed at the upper valve portion 52. The operation of these lower valve portion 50 and the upper valve portion 52 will be described in detail hereinafter.

It is to be noted that the valve cams 32, 42, and 60 are illustrative only, and as such are shown circular without the traditional cam offset for operating the valve for which each individual cam is associated.

The coil springs 30, 40, and 62 normally keep valves 26, 36, and 50 closed, until cam actions by cams 32, 42, and 60 operate at proper cycle to open the valves which they serve.

A fuel injector inlet 64 is mounted at the top of the hot chamber housing 66. The hot chamber housing 66 consists of two parts (not separately numbered), an upper portion and a lower portion. As illustrated, the upper portion contains the apertures for the hot chamber valve stem 56 and the fuel injector inlet 64 from a fuel injector system. Also, as illustrated, the lower portion is an integral part of the valve system means 16. The lower portion contains the port means 68 communicating between the interior of the cylinder means 12 and the interior of the hot chamber 46.

Referring now to FIG. 1 in conjunction with FIGS. 2 through 7 successively, the operation of the six-cycle engine of this invention will be described hereinafter.

Figure 2:
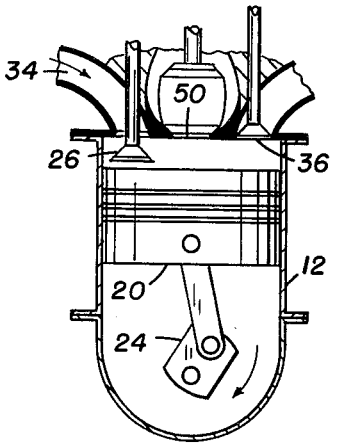
FIG. 2 is a schematic depiction of the valve and piston operation of a six-cycle engine on the first intake stroke.

FIG. 2 illustrates the piston 20 starting in a downward direction for the first intake stroke cycle to draw air into the cylinder means 12. The intake valve 26 is open and hot chamber lower valve portion 50 and exhaust gas valve 36 are closed. As the piston 20 moves downward the air is drawn into the interior cavity of the cylinder means 12 until the piston reaches the bottom of its stroke for the completion of the first cycle. The direction of rotation of the crankshaft 24 is shown in each of FIGS. 2 through 7. The air enters through air intake port 34, as indicated by the arrow, and then through the valve into the cylinder means 12.

Figure 3:
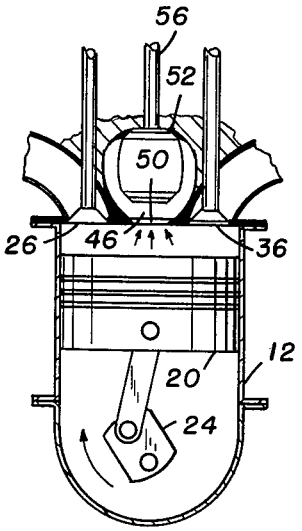
FIG. 3 is a schematic depiction of the valve and piston operation of a six-cycle engine on the first compression stroke.

In the second cycle, FIG. 3, the piston 20 is moving upward to compress the air, in the cylinder means 12, which was drawn in on the first cycle. Intake valve 26 and exhaust valve 36 are closed and the hot chamber valve portion 50 is open. The upward moving piston 20 compresses most of the aforementioned air into the hot chamber 46 through the open hot chamber valve portion 50. At the same time, hot chamber valve portion 52 is closed to seal off the aperture around the hot valve stem 56 during the extra high pressure at this time and in the subsequent second compression stroke to be described in conjunction with FIG. 5. The spherical-like configuration of the hot chamber 46 and its spherical-like enclosing walls is able to withstand the extra high pressures aforementioned by the very spherical-like design. As will be mentioned later herein, in the continuous operation of this six-cycle engine, the first intake stroke (FIG. 2) follows the exhaust stroke (FIG. 7) while the interior of the hot chamber 46 is still in a heated state, retaining heat from the burning of the fuel in the power stroke and not completely exhausted by the very design and positioning of the hot chamber 46 in relation to the other elements. Thus, the air taken in (FIG. 2) when compressed (FIG. 3) absorbs a greater amount of retained heat than is possible in the prior art.

Figure 4:
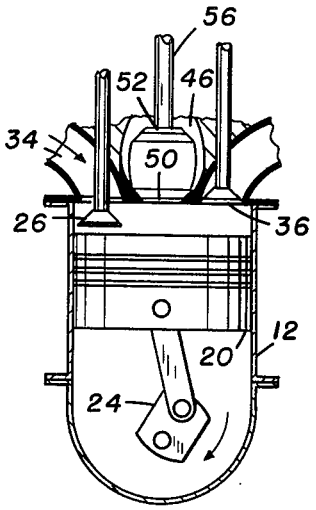
FIG. 4 is a schematic depiction of the valve and piston operation of a six-cycle engine on the second intake stroke.

As the piston 20 moves downward in FIG. 4 to make the second intake stroke or third cycle to draw in a second supply of air, the hot chamber valve portion 50 closes (and concurrently the hot chamber valve portion 52 moves with it). The exhaust valve 36 remains closed and intake valve 26 opens to admit the air through the intake port 34.

As the piston 20 moves upward again (FIG. 5) the second compression stroke cycle is a repeat of the first compression stroke cycle (FIG. 3) as hereinbefore described. Intake valve 26 closes, exhaust valve 36 remains closed, hot chamber valve portion 50 opens (operation as hereinbefore described), and the second intake of air is compressed and at the proper moment, when pressures are approximately equal, is the moment when the said hot chamber valve portion 50 opens to let the preheated compressed air of the first intake cycle intermingle with the now compressed air of the second intake cycle.

Figure 5:
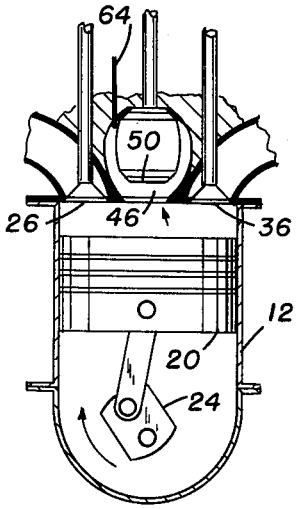
FIG. 5 is a schematic depiction of the valve and piston operation of a six-cycle engine on the second compression stroke.

At the precise predetermined and timed moment, the fuel is injected into the total compressed air mass through the fuel injector inlet 64. The fuel is injected into the total compressed air mass through the hot chamber 46 (FIG. 5). Thus, the fuel enters the location of the majority of the aforementioned preheated compressed air and is itself immediately raised in temperature. The mixture is now ready for ignition and the immediately following power stroke (FIG. 6).

Figure 6:
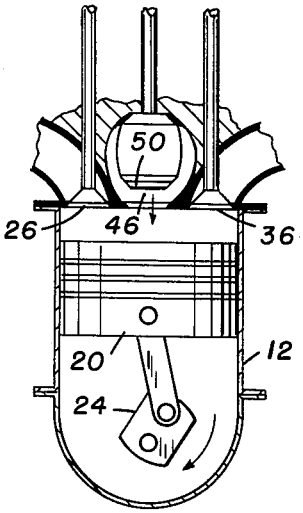
FIG. 6 is a schematic depiction of the valve and piston operation of a six-cycle engine on the power stroke.
Figure 7:
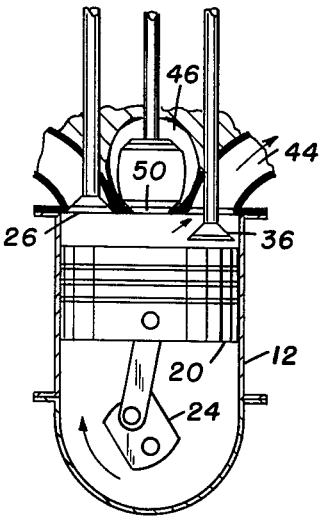
FIG. 7 is a schematic depiction of the valve and piston operation of a six-cycle engine on the exhaust stroke.

As the fuel mixture ignites, the piston 20 is driven downward for the power stroke cycle (the fifth cycle, FIG. 6). Intake valve 26 and exhaust valve 36 remain closed and the hot chamber valve portion 50 remains open. As the ignited fuel mixture expands during combustion the expanding gas flows out of the hot chamber 46 through the hot chamber port means 68. This initiation of the ignited fuel in the hot chamber 46 and the subsequent burning of the fuel within the hot chamber 46, as well as within the cylinder 12, is a means of preheating the interior of the hot chamber 46 for the subsequent preheating of the first intake air in the first cycle (which is the cycle which will follow the exhaust cycle FIG. 7).

The unobstructed flow of the ignited fuel mixture out of the hot chamber 46 is aided by the barrel-like hot chamber valve 48. The curved surfaces of the hot chamber valve 48 permits the flow of the rapidly expanding ignited gas to escape through the hot chamber port means 68 with a minimum of turbulence or obstruction as would be present if the normal valve configuration had been used.

In the sixth or last cycle of the six-cycle engine 10, the burned gases are eliminated by the upward movement of the piston 20 through the exhaust valve 36, which is now open, and out through the exhaust port 44 as designated by the arrow in FIG. 6. Intake valve 26 remains closed, and hot chamber valve portion 50 closes slowly to permit the escape of most of the burned gas from the hot chamber 46 by the induced suction of the burned gas passing out the exhaust port 44. As the exhaust stroke cycle (sixth cycle) ends the hot chamber valve portion 50 closes to trap the remaining heat within the hot chamber 46 and also to prevent premature heating of the new air by contact with the heated walls as the air is drawn in by the first intake cycle as hereinafter described.

It is to be noted that this invention of a six-cycle engine is suitable for use with the gasoline-type fuels or with diesel-type fuels. Ignition would be made accordingly by spark, "glow head", or compression means in the traditional manner.

The cams illustrated in phantom in FIG. 1 are illustrative only as hereinbefore mentioned and have not been shown with the traditional cam nodes for operating the valve stems or valve stem lifters. It is to be understood that such traditional cam nodes would be included in the cam design, but such elements are not a part of the improved art of this invention.

As can be readily understood from the foregoing description of the invention, the present structure can be configured in different modes to provide the ability to construct a six-cycle engine.

Accordingly, modifications and variations to which the invention is susceptible may be practiced without departing from the scope and intent of the appended claims.

What is claimed is:

1. A six-cycle engine comprising:

a housing structure;

a cylinder means, said cylinder means being encased in said housing structure;

a crankcase means, said crankcase means being affixed to said housing structure;

a crankshaft means, said crankshaft means being positioned in said crankcase means;

a valve system means, said valve system means consisting of an air intake valve, a compression chamber valve, and an exhaust gas valve, said valve system means being affixed to said housing structure;

a compression chamber, said compression chamber being spherical-like in configuration, said compression chamber being centrally located over and adjacent to said cylinder means and located within said valve system means; and a head means, said head means being affixed to and enclosing external portions of said valve system means; wherein said spherical-like compression chamber communicates with said cylinder means through an aperture therebetween, said compression chamber valve being located within said compression chamber and being so arranged so as to periodically at predetermined times for predetermined periods open and close said aperture by which said compression chamber communicates with said cylinder means, said compression chamber valve having a valve stem affixed thereto and passing through a wall of said compression chamber;

and wherein the configuration of said compression valve being barrel-like and having a slightly smaller diameter than that of said compression chamber, a first end of said barrel-like compression valve seating in said aperture when communication between said compression chamber and said cylinder means is to be closed, a second end of said barrel-like compression valve seating around said valve stem of said compression valve at said wall when communication between said compression chamber and said cylinder means is to be open and said first end of said compression valve is lifted from said aperture.

2. The six-cycle engine as recited in claim 1 and additionally, a piston and piston rod, said piston and piston rod being assembled in said cylinder means, said piston rod being assembled to said crankshaft in said crankcase means.

3. The six-cycle engine as recited in claim 1 and additionally, a fuel injection system, said fuel injection system having a fuel injection inlet into said compression chamber.

4. The six cycle engine as recited in claim 3, wherein said six cycles are:

a first air intake stroke cycle;

a first compression stroke and storage cycle;

a second air intake stroke cycle;

a second compression stroke cycle;

a power stroke cycle; and an exhaust stroke cycle.

5. The six cycle engine as recited in claim 4, wherein during said first compression stroke cycle, the air received during said first air intake cycle is compressed into said compression chamber and temporarily stored therein by closing said compression chamber valve.

6. The six cycle engine as recited in claim 5, wherein air compressed in said compression chamber is preheated by absorbing heat from the environment of said compression chamber, said walls having been heated by combustion of fuel mixture during prior power stroke cycle.

7. A six-cycle engine comprising:

a housing structure;

a cylinder means, said cylinder means being encased in said housing structure; a piston and piston rod assembled in said cylinder means:

a crankcase means having a crankshaft positioned therein and being affixed to said housing structure; said piston rod being assembled to said crankcase in said crankcase means;

a valve system means, said valve system means consisting of an air intake valve, a compression chamber valve, and an exhaust gas valve, said valve system means being affixed to said housing structure;

a compression chamber, said compression chamber being centrally located over and adjacent to said cylinder means and within said valve system means, said compression chamber being spherical-like, said spherical-like compression chamber being centrally located over said cylinder means, said spherical-like compression chamber communicating with said cylinder means through an aperture therebetween, said compression chamber valve being located within said compression chamber and being so arranged so as to periodically at predetermined times for predetermined periods open and close said aperture by which said compression chamber communicates with said cylinder means, said compression chamber valve having a valve stem affixed thereto and passing through a wall of said compression chamber;

a head means, said head means being attached to and enclosing external portions of said valve system means, with the configuration of said compression chamber valve being barrel-like and having a slightly smaller diameter than that of said compression chamber, a first end of said barrel-like compression valve seating being in said aperture when communication between said compression chamber and said cylinder means is to be closed, a second end of said barrel-like compression valve seating around said valve stem of said compression valve at said wall when communication between said compression chamber and said cylinder means is to be open and said first end of said compression valve is lifted from said aperture, and additionally, a fuel injection system, said fuel injection system having a fuel injection inlet into said compression chamber.

* * * * *